United States Patent [19]

Gach et al.

[11] 4,446,979

[45] May 8, 1984

[54] TAMPER INDICATING CLOSURE

[75] Inventors: Peter P. Gach; Randall G. Bush, both of Evansville, Ind.

[73] Assignee: Sunbeam Plastics Corporation, Evansville, Ind.

[21] Appl. No.: 466,058

[22] Filed: Feb. 14, 1983

Related U.S. Application Data

[63] Continuation-in-part of Ser. No. 310,081, Oct. 9, 1981, abandoned.

[51] Int. Cl.[3] ..... B65D 55/02; A61J 1/00; B65D 85/56

[52] U.S. Cl. ..... 215/203; 215/211; 215/220

[58] Field of Search ..... 215/203, 211, 220, 219

[56] References Cited

U.S. PATENT DOCUMENTS

| | | | |
|---|---|---|---|
| 2,201,205 | 5/1940 | Samburg | 215/7 |
| 2,414,420 | 1/1947 | Sebell | 215/43 |
| 2,939,597 | 6/1960 | Greene | 215/7 |
| 3,073,468 | 1/1963 | Arneson | 215/7 |
| 3,756,445 | 9/1973 | Hedgewick | 215/211 |
| 4,223,794 | 9/1980 | Morris | 215/220 |
| 4,271,971 | 6/1981 | Morris | 215/203 |
| 4,371,088 | 2/1983 | Gach | 215/220 |

*Primary Examiner*—George T. Hall

*Attorney, Agent, or Firm*—Fisher, Gerhardt, Crampton & Groh

[57] ABSTRACT

A tamper indicating closure including an outer cap and an inner liner which relies on relative movement of the outer cap and the inner liner during opening movement to indicate tampering of the container after it has been sealed for the first time, the relative movement being insured by a means which coact with the container to resist rotation of the liner and maintain the container in a sealed condition while the outer cap is being rotated in an opening direction. Once opened, the outer cap and the inner liner are maintained in a position for movement as a unit in both the opening and closing direction of the closure.

39 Claims, 20 Drawing Figures

Fig-3
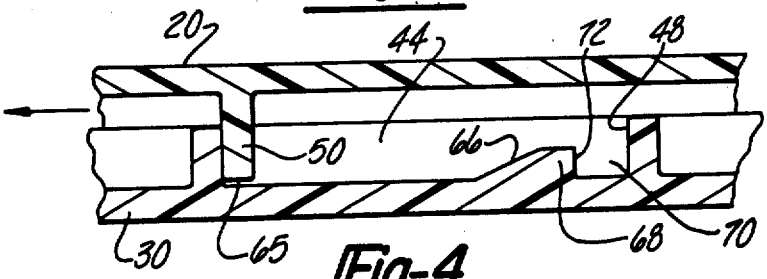
Fig-4
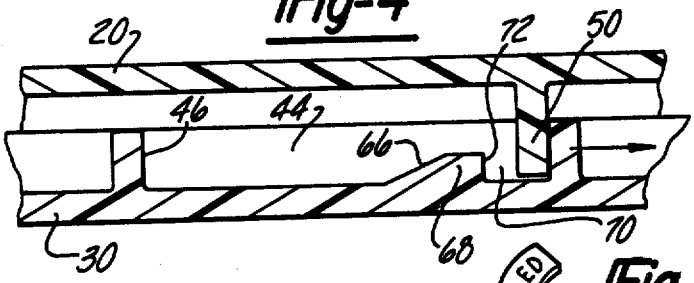
Fig-5
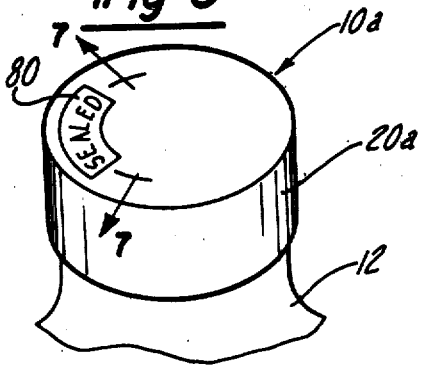
Fig-6
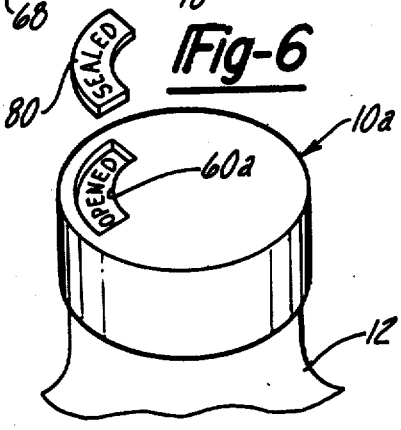
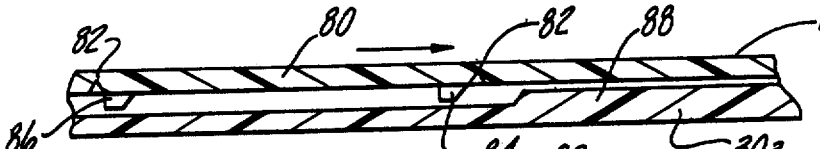
Fig-7
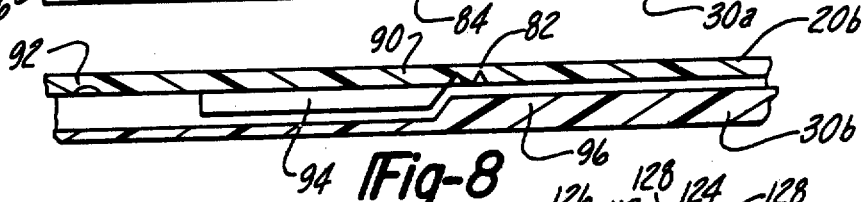
Fig-8
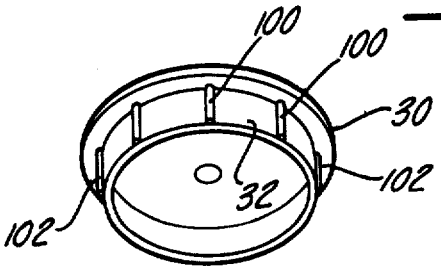
Fig-9
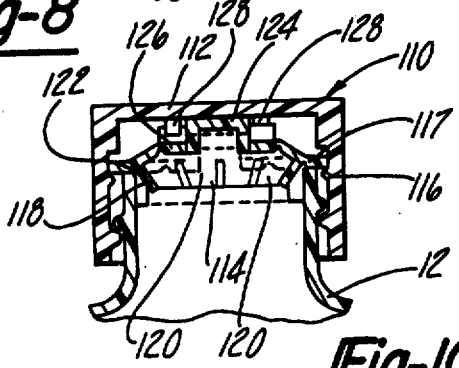
Fig-10

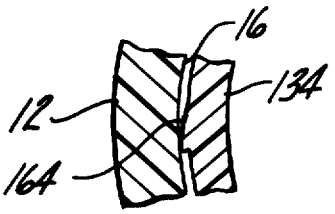
Fig-13
Fig-14
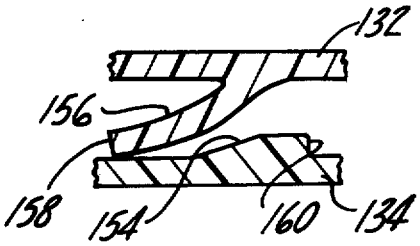
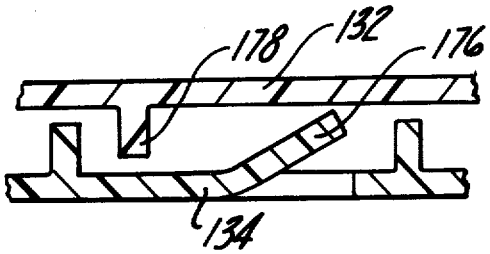
Fig-15
Fig-16
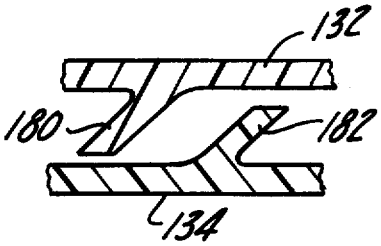
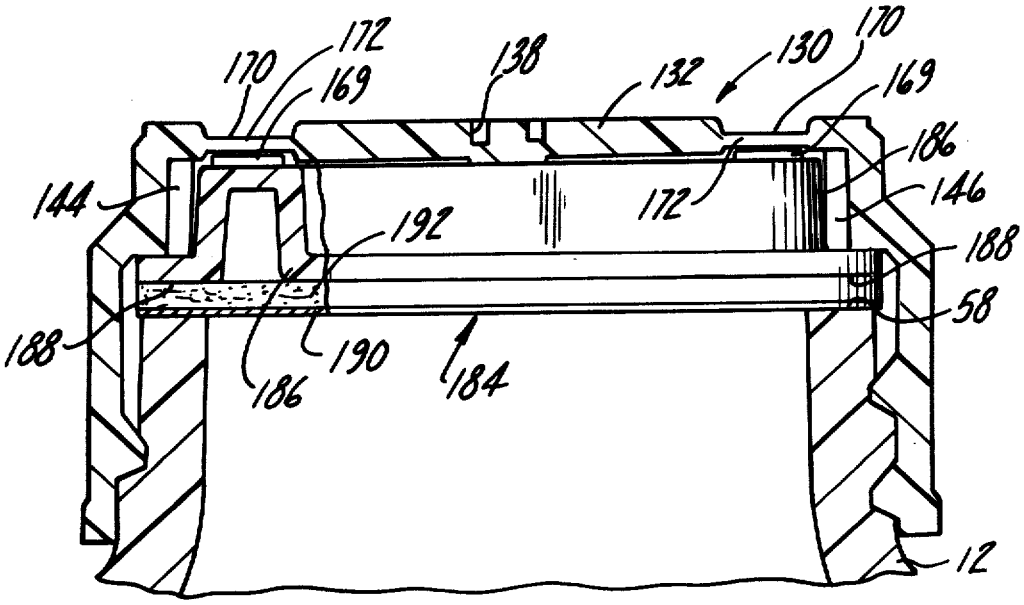
Fig-17

Fig-18
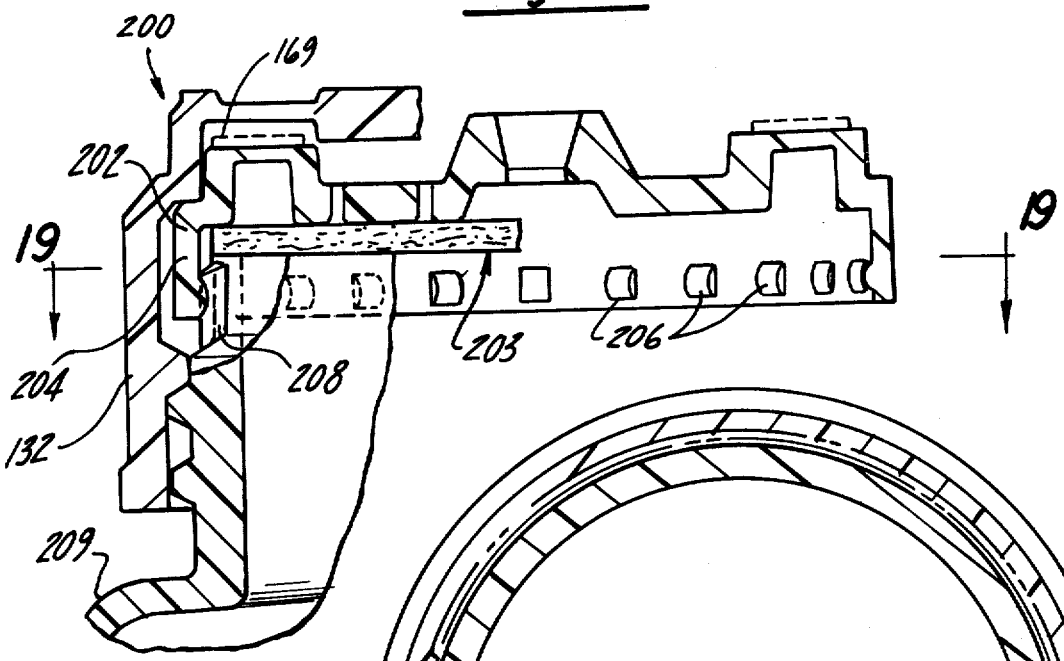
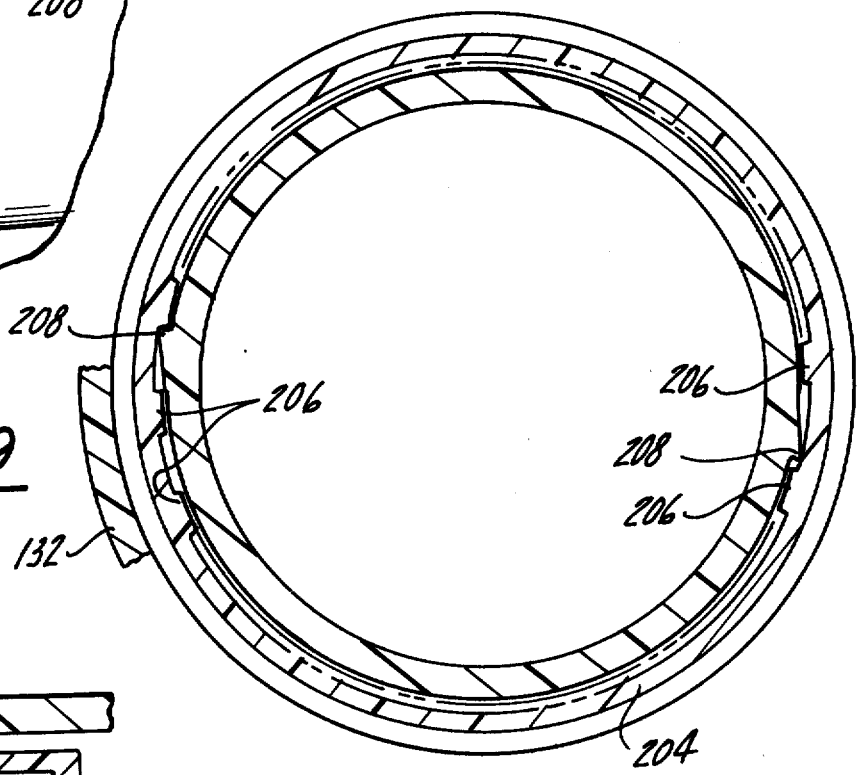
Fig-19
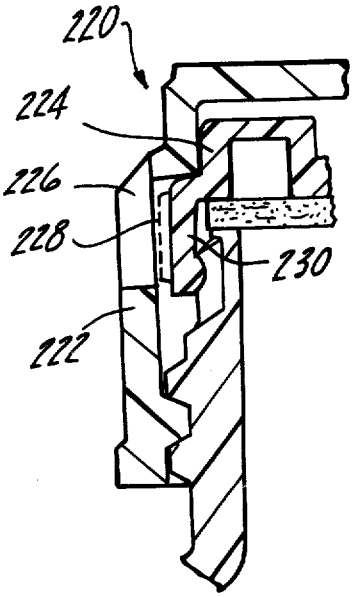
Fig-20

TAMPER INDICATING CLOSURE

This application is a continuation-in-part of application Ser. No. 310,081 filed Oct. 9, 1981, now abandoned.

This invention relates to closures for containers and more particularly to closures of the type which indicate tampering.

There are a large variety of closures for containers which attempt to give evidence that the container has been opened or at least been placed in a condition for opening once it has been filled. The purpose of such closures is to insure that consumers can be confident that a closure has remained in a closed position once it has been filled and not opened prior to its purchase.

It is a general object of this invention to provide a tamper indicating closure which does not require a special container and therefore can be used with a wide variety of containers of standard configuration.

Still another object of the invention is to provide a tamper indicating closure which can give a worded message indicating that the closure has once been opened or placed in condition for opening.

Yet another object of the invention is to provide a tamper indicating closure of simple two-part construction which provides for easy manufacture and assembly.

The objects of the invention are accomplished by a tamper indicating closure having a cap portion for threaded engagement with the threaded neck of a container and having a liner capable of sealing the closure. The closure provides for complementary drive and driven surfaces which permit the cap to be placed on the container for the first time after it is filled to move the liner into a sealed condition. Other complementary drive and driven surfaces are provided which come into engagement with each other after the cap has been rotated relative to the stationary liner to provide a message or a condition of the closure giving evidence that the closure has either been removed from the container or placed in a condition relative to the container by which it can be moved. These complementary drive and driven surfaces enable the cap and liner to be moved as a unit to a fully opened position. Additional cooperating drive and driven surfaces are provided which insure that the closure can be replaced on the container once it has been removed while at the same time the condition of the closure remains established to give evidence of the opened condition.

The presently preferred embodiments are illustrated in the accompanying drawings in which:

FIG. 3 is a cross sectional view taken on the arcuate line 3—3 in FIG. 1;

FIG. 4 is a cross sectional view similar to FIG. 3 but showing another condition of operation;

FIG. 5 is a perspective view of another embodiment of the invention showing the closure in its initially closed position relative to a container, only a portion of which is shown;

FIG. 6 is a view similar to FIG. 5 showing the condition of the closure once it has been placed in condition for opening;

FIG. 7 is a cross sectional view taken generally on the arcuate section line 7—7 in FIG. 5;

FIG. 8 is a cross sectional view similar to FIG. 7 showing a modification of the embodiment seen in FIG. 7;

FIG. 9 shows a modification of a portion of the closure in the prior embodiments of the invention;

FIG. 10 shows still another embodiment of the invention in a cross sectional view similar to FIG. 2;

FIG. 13 is a cross sectional view taken generally on line 13—13 in FIG. 11;

FIG. 14 is a diagrammatic cross sectional view showing the relationship of elements in FIGS. 11 and 12;

FIGS. 15 and 16 are diagrammatic cross sectional views similar to FIG. 14 showing variations of the elements in FIG. 14;

FIG. 17 is a cross sectional view similar to FIG. 11 showing a modification of the embodiment of the invention seen in FIG. 11;

FIG. 18 is a view similar to FIG. 17 with parts broken away and removed showing a further modification of the invention adapted to be used with standard forms of sealing elements;

FIG. 19 is a cross sectional view taken generally on line 19—19 in FIG. 18; and

FIG. 20 is further modification of the embodiment illustrated in FIG. 18.

Figure 1:
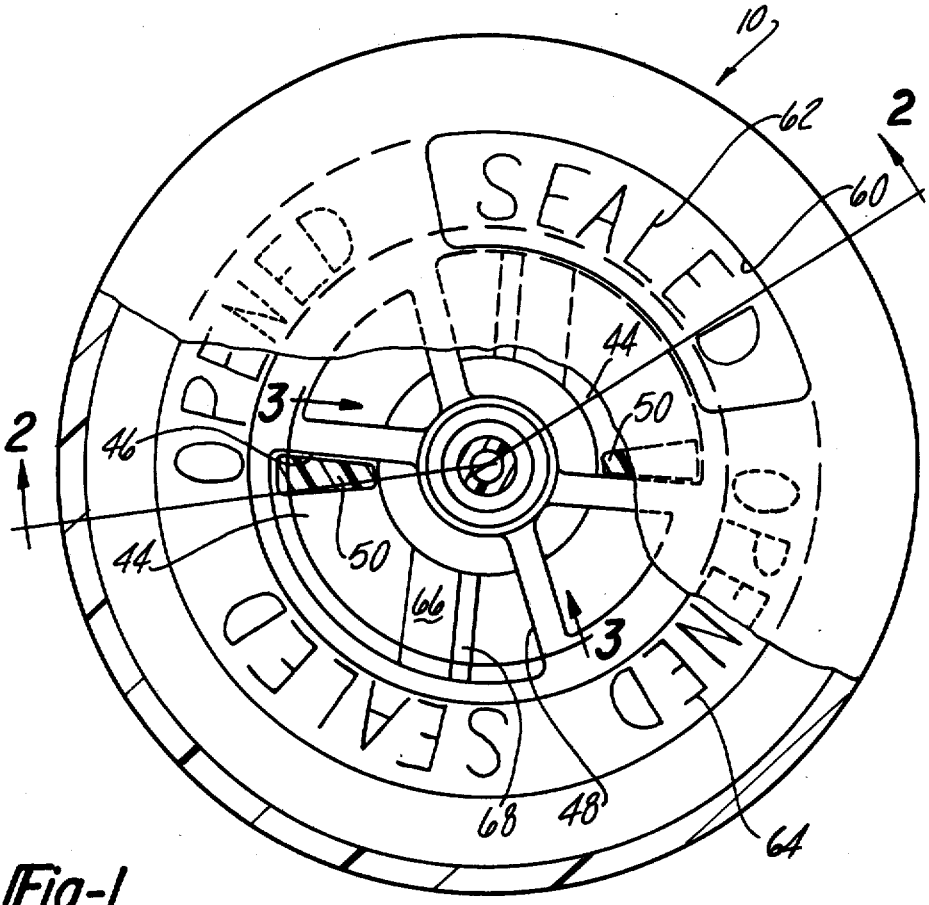
FIG. 1 is a top view of the closure embodying the invention with parts broken away and removed.

A tamper indicating closure embodying the invention is designated generally at 10 and is adapted for use with containers 12 having a neck 14 forming an opening 16 through which contents can be introduced and dispensed from the container. The exterior of the neck 14 has external threads 18 adapted to receive complementary threads on the closure 10.

The closure 10 includes a cup-shaped cap 20 with a generally flat top 22 and a depending annular skirt 24. The skirt 24 is provided with internal threads 26 complementary to the threads 18 on the exterior of the neck of the container 12. The closure 10 also includes a liner member 30 which is disposed within the cup-shaped cap 20. The liner member 30 is provided with a depending annular flange 32 having an outer, annular cylindrical friction ring or surface 34 which is seated in engagement with the inner wall 35 of the opening 16 in the neck 14 of the container 12. A cam surface 36 is provided below the friction surface 34 to act as a guide upon introduction of the liner member 30 into the opening 16 in the neck 14 of the container 12.

The liner member 30 is supported relative to cap 20 by a central depending, hollow post 38 formed integrally with the cap 20 which projects through an opening 40 axially of the member 30. The end of post 38 projecting through the opening 40 is deformed to form a rivet like head 42 by which the liner member 30 is maintained in assembled relationship with the cap 20 . This supporting arrangement permits rotational movement of the liner member 30 relative to the cap 20 and at the same time permits a small amount of relative axial movement. Both the cap 20 and the liner 30 can be molded of similar or of different plastic materials which permit some deflection relative to each other. For example, the cap can be made of polyproplyene to enhance thread engagement whereas the liner may be made of high density polyethylene.

The liner member 30 has a pair of symmetrical recesses 44 disposed arcuately of the axis of the liner member 30. Opposite ends of the recesses 44 have walls 46 and 48 which form stop or driven surfaces that are engageable by a drive lug 50, one of which is disposed in each of the recesses 44 and are formed integrally with the cup-shaped cap member 20.

Figure 2:
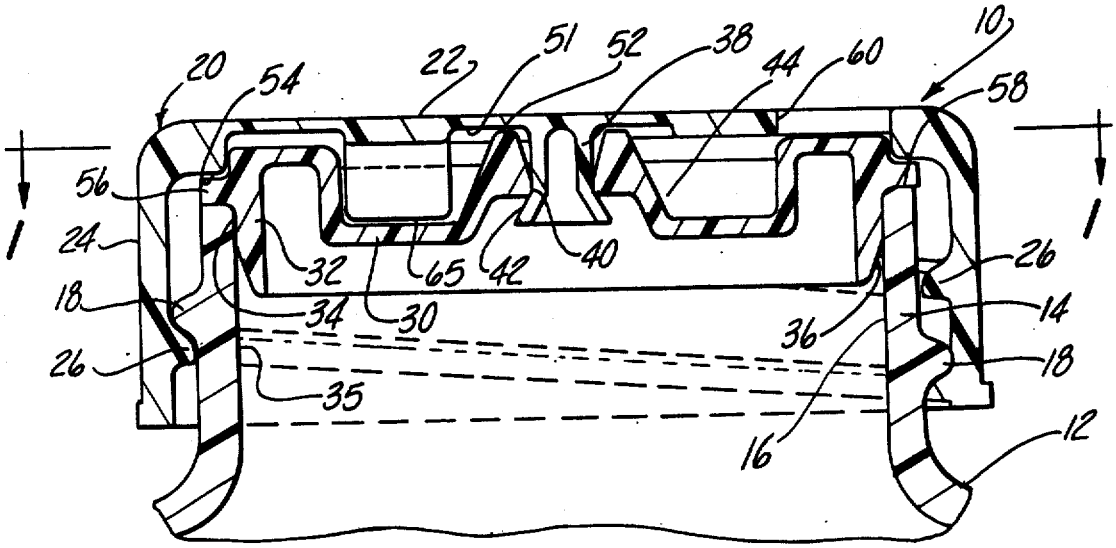
FIG. 2 is a cross sectional view taken on line 2—2 in FIG. 1.

As seen in FIGS. 1 and 2 the lugs 50 are in engagement with the walls 46 so that clockwise rotation of the cap 20 is effective to move the cap 20 and liner 30 as a unit to bring the complementary threads 18 and 26 into engagement with each other to move said closure 10 in a closing direction. Such movement causes the closure 10 to move axially relative to the container so that the cam surfaces 36 enter the opening 16 in the neck 14 and subsequent clockwise threaded rotation causes the cylindrical friction surface 34 to be moved axially into seated engagement with the internal surface 35 of the opening 16. Such axial movement is transmitted from the cap 20 to the liner member 30 by means of engaging surfaces 51 around the base of the post 38 on the cap 20 and an annular surface 52 surrounding the opening 40. In addition, an annular force transmitting surface 54 is formed adjacent the interior circumferential area of the cap 20 as seen in FIG. 2 for engagement with a force transmitting flange 56. The surfaces 54 and flange 56 are complementary to each other and as the cap 20 is threaded onto the neck of the container 12 the liner member 30 is forced axially and downwardly to bring the cylindrical friction surface 34 into engagment with the interior surface of the opening in the neck. When the closure 10 is in the fully closed position, the friction surface 34 is engaged with the interior of the opening in the neck over an axial range which insures continued contact before the closure is in its fully closed position. In the fully closed position, the bottom of the flange 56 forms a seal which is pressed into engagement with the top lip 58 of the neck 14. In addition to providing an axial cylindrical extent of friction surface, the exterior diameter of the surface 34 has a slightly larger outer diameter than the diameter of the opening 16 in the neck 14 and with a smooth exterior can act as a seal. Preferably the liner member is made of a plastic material which has some elastomeric qualities permitting deformation and movement to a seated position.

In the initially closed position of the closure 10 on the container 12, the drive lugs 50 will be in engagement with the walls 46 of the recessess 44 in which case a window 60 formed in the top 22 of the cap 20 is in alignment with a message or indicia indicated at 62. In the illustrated embodiment of the invention the indicia 62 is in the form of the word "sealed". This is the message that will appear after the container 12 has been filled and closed with a closure 10 either manually or automatically for the first time.

To open the closure 10 and remove it from the container 12, the cap 20 is grasped in conventional fashion and is rotated in a counterclockwise direction as viewed in FIG. 1. During such rotational movement of cap 20 in a counterclockwise direction, the liner member 30 remains stationary relative to the neck 14 because of the interference fit and large surface engagement of the friction surface 34 with the interior of the opening 16. This causes the lugs 50 to move out of engagement with the walls 46 toward the walls 48.

When the drive lugs 50 eventually come into engagement with the walls 48, when the cap 20 is rotated in a counterclockwise direction, the window 60 will have moved out of alignment with the indicia 62 and into alignment with the second message or indicia indicated at 64. In this instance the message is that container has been opened.

Prior to the time that the lugs 50 come into engagement with the walls 48 upon clockwise movement of cap 20 in an opening direction, the lugs 50 must move through an arc of 30° or more at which time the lower ends 65 of the lugs 50 simultaneously engage cam surfaces 66 formed on ramp elements 68 formed integrally with the seal member 30 at the bottom of each of the recesses 44.

The relatively moveable cap causes the lug ends 65 to engage the cam surfaces 66 so that the cap 20 is deflected axially relative to the liner 30 until the lugs 50 pass to the other side of the ramp elements 68 at which point the lugs will snap into cavities 70 formed within the recesses 44 between the ramp element 68 and the wall surface 48. When the lug 50 has reached this position, the window 60 will be in alignment with the indicia 64 indicating that the container has been placed in the condition by which it can be opened. Subsequent counterclockwise rotation of the cap 20 brings the lugs 50 into engagement with the walls 48 so that additional rotation moves the cap 20 and liner 30 as a unit so that the closure 10 moves axially and the cylindrical friction surface 34 moves out of engagement with the interior of the neck 14 so that the closure 10 can be completely removed from the container.

During initial movement of the lug 50 from the sealed position of the closure 10 until the lug approaches the cam surface 66 the cap 20 will have been moved through approximately 30° of arc which results in a corresponding axial movement of the cap 20. During such time the liner 30 remains nonrotatably fixed relative to the opening in the neck so that the container remains sealed. Such movement of the cap causes the force transmitting surface 54 and flange 56 to move out of engagement with each other and separate so that the only force applied by the cap 20 to the seal 30 is by way of the lug ends 65 on the cam surface 66. This force is a minimum and substantially less than the friction generated between the cylindrical friction surface 34 and the internal surface of the opening in the neck 14. In this manner the frictional forces between the cap and seal 30 which might tend to rotate the seal are minimized and kept less than the friction at the surface 34.

After the closure 10 has once been removed from the container 12 the window 60 will be in alignment with the indicia 64 indicating that the closure has been opened. Upon replacement of the closure 10 relative to the container 12, the cap 20 is rotated in a clockwise direction. This brings the opposite surfaces of the lugs 50 into engagement with a stop wall or driven surface 72 formed opposite to the cam surface 66 on the ramp element 68. In this position the window 60 remains in alignment with the indicia 64 showing that the closure 10 has been opened and at the same time affords a means by which the driving lug 50 transmits counterclockwise motion to the seal so that the cap 20 and liner 30 are moved axially as a unit to bring the cylindrical friction surface 34 into engagement with the interior of the neck opening 16.

Referring now to FIGS. 3 and 4 it will be noted that the depth of the recesses 44 formed by the walls 46 and 48 is deeper than the height of the ramp element 68. This dimensioning insures that lugs 50 are not deflected upwardly a distance greater than the height of the wall surfaces 46 and 48 to insure that the lugs will be precluded from passing the walls 46 and 48 in both the closing and opening directions of the closure 10. Also the height of the ramp element 68 is selected to be of an axial dimension greater than any axial movement that may be permitted between the cap 20 and seal 30 by the post 38 in the opening 40. This insures that as the lug 50 passes over the ramp element 68, the cap 20 and liner 30 must deflect relative to each other and the lower end of the lug 65 is returned axially into the cavity 70. This insures engagement of the lugs 50 with the stop surfaces 72 when the cap is moved in a closing direction for the purpose of returning the closure 10 to its sealing position on the container 12.

With the internal diameter of the opening 16 in the neck 14 of the container 12 known, it is possible to easily select an interfering dimension for the outer cylindrical sealing surface 34 which will insure interference and friction so that there is resistance to rotation of the liner 30 relative to the container 12 during rotation of the cap 20 from its closed to its open position.

It will be noted that the recesses 44, walls 46, 48 and lugs 50 and cavity 70 are arranged in pairs diametrically opposite each other. It will be understood of course that an even or odd number of such elements could be disposed uniformly and circumferentially of the cap 20 and liner 30. In the described embodiment in which pairs are used, the liner 30 is provided with two sets of indicia 62 and 64 also arranged diametrically opposite each other. This makes it possible to assemble the cap 30 and liner 30 so that a selected one of the lugs 50 can be disposed in either of the cavities 44. Also, since there is a substantial arc between the walls 46 and the ramp elements 68 the assembly procedure does not require precise alignment of the cap 20 and liner 30 thereby facilitating more simple assembly equipment and techniques.

Referring now to FIGS. 5, 6 and 7 another embodiment of the invention is illustrated which in all respects can be the same as the embodiment of the invention disclosed in FIGS. 1 through 4 except that the cap 20 is provided with a window **60*a*, which in the closed position of the closure 10*a* on the container 12 is provided with a cover element 80. The cover element 80 defines an arcuate portion secured to the remainder of the cap 20*a* by lines of weakening or frangible areas indicated at 82 in FIG. 7. The underside of the cover element 80 is provided with cam elements 84 and 86 which are adapted to engage a platform 88 formed on the top of a liner member 30*a*. The top of the cover element 80 can be provided with a message such as the word "sealed" and the top of the platform 88** can be provided with a message such as the word "opened".

The operation of the embodiment in FIGS. 5 through 7 is the same as the prior embodiment in that during opening movement of the closure **10*a* the liner member 30*a* remains stationary relative to the neck 14 of the container 12 but upon engagement of the cam 84 with the platform 88 the cover element 80 will be deflected and the adjacent frangible portions will fracture. Similarily, when the cam element 86 engages the platform 88 the adjoining frangible portions 82 will break away so that the cover element 80 becomes separated from the remainder of the cap 20*a*. This leaves an open window 60*a* which exposes the message "opened" on the platform 88. In this manner, once the closure 10*a* has been put in condition for opening the message on the platform 88 will remain within the window 60*a* because the drive lugs 50 will be in the cavity 70 as illustrated in FIG. 4 so that during all subsequent opening and closing movement the platform will be visible through the window 60*a***.

A further modification of the embodiment in FIGS. 5 through 7 is illustrated in FIG. 8 in which a cover portion 90 is separated on three sides by lines of weakening and frangible portions 82. However, at least one end of the cover portion 90 remains attached to the remainder of the cap member 20 at a hinge point 92. In this modification of the invention a cam portion 94 on the underside of the cover element 90 comes into engagement with the platform 96 upon rotation of the cap **20*b* to raise the cover element 90 and hinge it about the hinge 92. In this version, opening movement is made apparent by the displacement of the cover portion 90 from other than a flat or flush condition with the remainder of the top of the cap. The cap 20*b* is held against rotation relative to the liner 30*b* by the positioning of the drive lugs 50 in cavity 70 so that the cap 20*b* and liner 30*b* rotate as a unit and the cam 94 remains in seated position on the platform 96 to keep the cover portion 90** displaced relative to the top of the cap to give evidence of tampering.

In the embodiments of FIGS. 5 through 8 opening movement is achieved while the liners **30*a* or 30*b* remain stationary relative to the neck 14 of the container due to the friction ring or surface 34 until such time as the drive element 50 engages the driven wall 46 on the liner 30*a* or 30*b***.

Referring now to FIG. 9, in some applications of the invehtion it may be necessary to vary the friction afforded by the friction surface or ring 34. In FIG. 9 this is accomplished by a plurality of ribs 100 formed on the exterior surface flange 32 to form a friction engaging surface 102. In this instance the number, spacing and degree of interference with the inside diameter of the neck 14 all may be varied to accurately control the amount of friction afforded by engagement of the ribs 100 with the interior of the neck 14.

Referring now to FIG. 10 still another embodiment of the invention is shown in which a closure 110 is adapted for use on a container 12 identical with those used with the other embodiments of the invention. The closure 110 includes a cup-shaped cap 112 with threaded engagement with the threads on the neck 14 of the container 12. Disposed within the cap 112 is a liner member 114 which is held against separation with the cap 112 by a retaining flange 116 formed on the inside of the cap 112 and engageable with the underside of an annular flange 117 at the outer periphery of the liner member 114. The liner member 114 includes an annular friction flange 118 adapted to fit within the opening 16 in the neck 14. The friction flange 118 can be formed in segments 120 which are hinged at 122 relative to the outer flange 117. A central portion of the liner member 114 is provided with a platform 124 and is adapted to engage the underside of the cap 112. When the cap 112 is placed on a container, the threads engage and the cap 112 forces the platform 124 axially to deflect the segments 120 about their hinges 122 to bring them into engagement with the inside wall of the opening 16 to provide the friction necessary to resist rotation of the liner member 114 during opening movement of the closure 110. An annular area 126 adjacent to the platform 124 can be provided with the driven surfaces similar to the surfaces 46, 48 and 72 and the cap 112 has drive lugs 128. Also the cap 112 can be provided with a window and tamper indicating indicia or mechanism of the prior embodiments.

A further embodiment of the invention is shown in FIGS. 11 through 15 in which a closure 130 includes a cup shaped member 132 and a cup shaped liner member 134. The closure 130 is similar in many respects to the closure 10 and operates in a similar manner to indicate the condition of the closure and container, that is, the container is sealed or it has been placed in a condition by which it can be opened thereby giving evidence of possible tampering.

The cup shaped liner 134 is supported within the cap 130 and is fastened at the axis of the cap by a post 136. The post 136 differs from the prior embodiments in that an annular groove 138 is formed in the top of the cap 132. The post 136 permits the liner 134 to be rotated relative to the cap 132 during normal closing and opening operations. However, if an effort is made to separate the cap 132 and liner 134, for example, by forcing the two parts axially relative to each other, the post 136 will break away from the remainder of the cap 132 because of the thin, frangible web 140. Such breaking away of the post 136 affords a further indication of tampering which is visible from an examination of the closure 130.

The cap 132 and the liner 134 can be rotated in a closing direction relative to a threaded container 12 by means of a pair of diametrically spaced lugs 144 formed internally of the cap 132 and extending radially inwardly to engage complementary portions in the form of a pair of tabs 146 formed on the exterior wall of the liner 134 and extending radially outwardly. Upon relative rotation of the cap 132 and liner 134 in the opposite direction, that is, counter-clockwise as viewed in FIG. 12, the lugs 144 engage with portions in the form of a pair of tabs 148. Disposing the on-drive and off-drive portions 144, 146 and 148 at the outer periphery of the closure 130 leaves the top portions of the cap 132 and liner 134 available for indicia and the ratchet or one-way drive arrangement which is important for smaller sized closures.

The top of the cup shaped liner 134 is provided with four ramp elements 150 each having a cam surface 152 and being disposed in the bottom of an annular recess 154 formed in the top of the liner member 134. The ramp elements 150 coact with four flexible elements 156 formed integrally with the underside of the cap 132. The flexible elements 156 act as leaf springs and when the cap 132 is rotated from a closed position in an opening direction relative to the liner 134, the flexible elements 156 engage the cam surfaces 152 of the ramp elements 150 and flex upwardly until the ramp elements 150 are passed after which the flexible elements 156 return to their normal position at the opposite side of the ramp elements 150. This will be the opening position of the closure 130 after which all further closing movements of the closure 130 will be brought about by engagement of the ends 158 of the flexible elements 156 with the walls 160 seen in FIG. 13. In this manner, the flexible elements 156 and the ramp elements 150 form one-way drive or ratchet means on the cap and liner members which permit relative movement of the cap 132 and liner 134 in one direction but which prevents relative movement in the opposite direction.

A cup shaped liner 134 has an annular flange 62 the outer surface of which has a plurality of ribs 164 similar to the rib 100 seen in FIG. 9. The ribs or teeth 164 have a saw tooth configuration and form friction surfaces which engage the inner wall of opening 16 of the container 12 seen in FIG. 2. During movement of liner 134 in a closing direction, for example, in a clockwise direction as viewed in FIG. 13, the shape of the teeth 164 permits relative free rotation relative to the container 12 to permit easy closing movement. However, in an opening direction, the teeth 164 tend to grip with the interior wall of the neck of the container to insure that liner 134 will remain stationary and that there will be relative movement between the cup shaped cap 132 and the liner 134 during the initial opening movement of the closure 130. In an actual embodiment of the invention, eight such teeth uniformly spaced 45° apart was found to be adequate.

The liner member 134 is provided with an annular lip seal 168 which is adapted to engage the top lip 58 of a container 12 and seal the contents of the container each time the closure 130 is returned to a closed position.

In the initially closed position, some indicia such as the words "sealed" and positioned at 169 will appear in a pair of diametrically disposed windows 170. The windows 170 are closed in that they have a transparent light 172 at the top surface of the cup shaped cap 132. The remainder of the cup shaped cap 132 is opaque. In the manufacturing process this is accomplished by making the cup shaped cap 132 entirely transparent and subsequently applying a coating of ink to the remaining outer surfaces of the cap 132. The closed but transparent windows 170 act to obstruct access to the cup shaped liner 134 making it more difficult to overcome the tamper indicating features of the closure 130.

It will be noted that a pair of windows 170 are disposed diametrically opposite each other and that the words "sealed" and "opened" or other comparable indicia 169, are formed in adjacent first and second sectors and that a second set of the same words are formed in third and fourth sectors. As a result, the pair of windows 170 simultaneously display either the words "sealed" in two of the sectors or the words "opened" in two other of the sectors.

When the closure 130 initially is placed on a container, the words "sealed" will appear and as the closure 130 is screwed onto the container of the pair of lugs 144 will engage the tabs 146 to move the annular flange 162 into the opening of the container and to bring the lip seal 168 into tight sealing engagement with the top lip 58 of the container. This is the only time the tabs 146 come into play. Thereafter, rotation of the cap 132 in an opening direction takes place relative to the stationary liner 134 held in relatively fixed relationship to the container by the annular flange 162 and teeth 164. During the relative turning movement of the cap 132 and liner 134 in an opening direction, the flexible elements or spring 156 pass over the ramp elements 150 so that the windows 170 become aligned with the words "opened". Thereafter, during repeated opening and closing operations of the closure 130, the lugs 144 will engage the tabs 148 during opening and the ends 158 of flexible elements 156 will engage the walls 160 during opening to limit relative movement of the cap 132 and liner 134 to maintain the window 170 aligned with the words "opened".

During the initial opening movement, the flexible elements 156 permits relative turning movement with a minimum amount of resistance as the flexible elements 156 pass over the ramp elements 150 thereby minimizing the requirements of the means acting between the liner 134 and the container to hold the liner relatively stationary during movement of the cap member.

Figure 11:
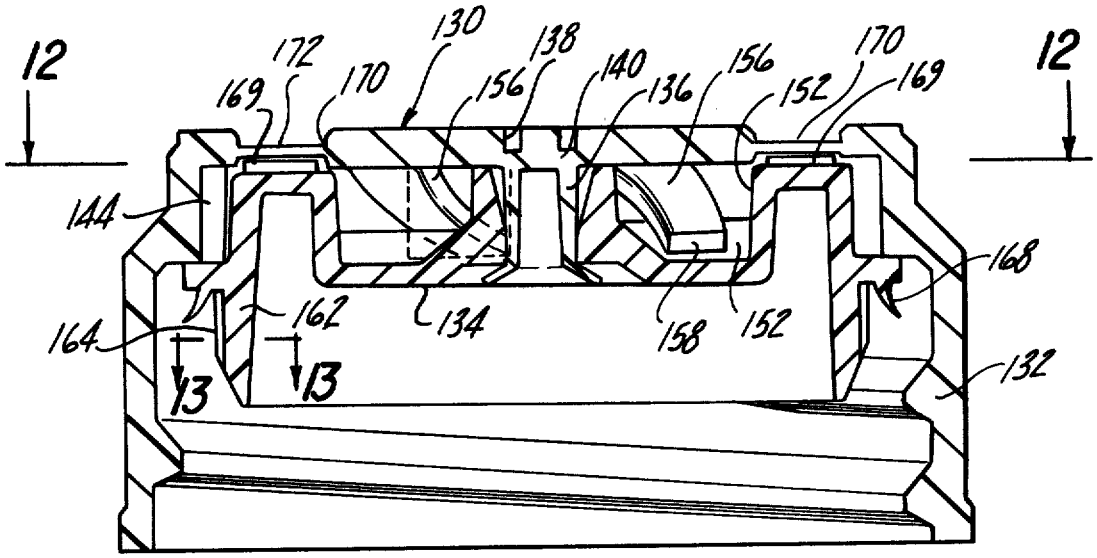
FIG. 11 is a cross sectional view of another embodiment of the invention.
Figure 12:
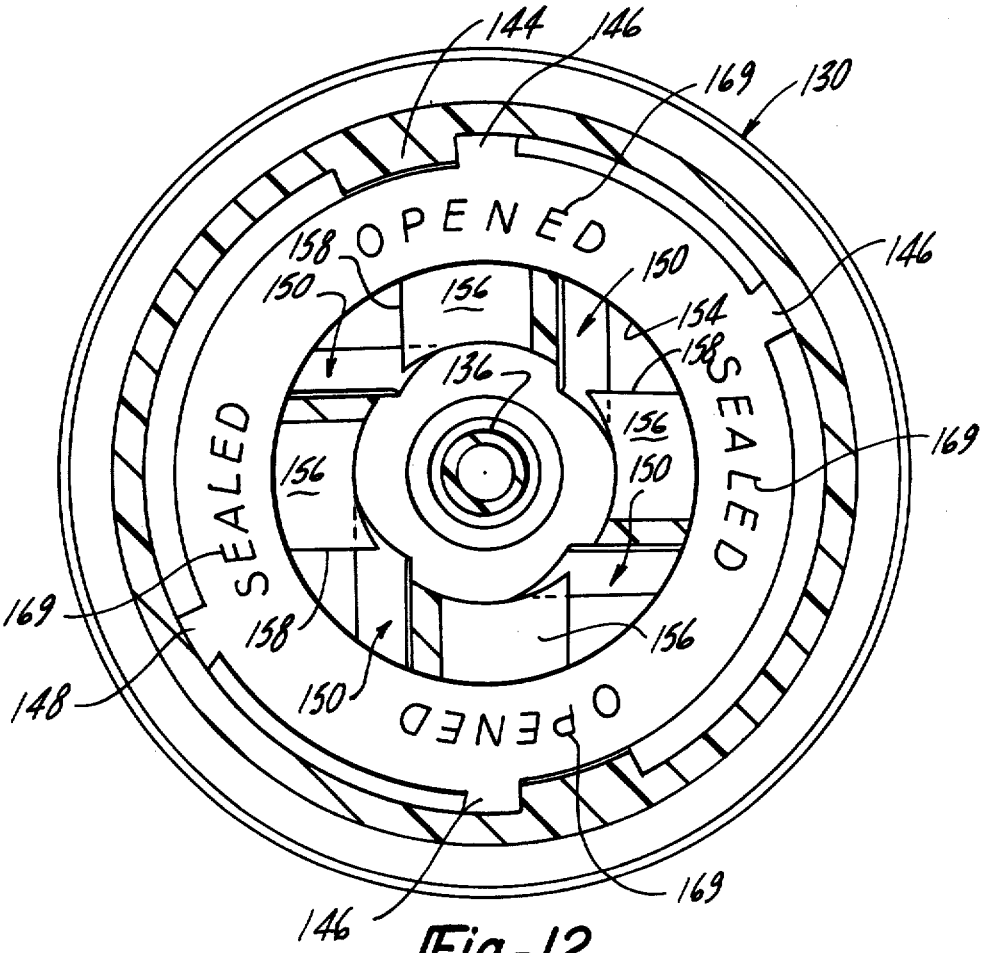
FIG. 12 is a cross sectional view taken on line 12—12 in FIG. 11.

Although the flexible elements 156 are shown associated with the cap 132 in FIGS. 11, 12 and 14, flexible elements 176 can be formed integrally with the liner 134 for engagement with lugs 178 formed on the caps 132 as illustrated in FIG. 15. Also, if desired, instead of a single set of flexible elements such as 156 or 176, a pair of flexible elements 180 and 182 can be used and the ramp elements 150 or lugs 178 eliminated. The operation of the closure 130 will be substantially the same with the spring arrangements seen in FIGS. 14, 15 or 16.

A modification of the closure 130 is illustrated in FIG. 17 which is particularly adapted for use with containers having conventional liners or seals indicated by the seal assembly at 184. In this case, the cap 132 remains identical but the liner member 134 is modified by eliminating the lip seal 168 and the plug type seal formed by the flange 162. This results in a liner member 186 having a flat outer peripheral edge 188 which engages the top of seal assembly 184. The seal assembly 184 includes a liner facing element 190 which can be made of metal foil or glassine material. The inner facing layer 190 is detachably fastened to a liner backing layer 192 by a material such as wax disposed between the two layers 190 and 192. The seal assembly 184 is fastened to the liner member 186 by adhesive on the top surface of the liner backing 192. When the closure 130 seen in FIG. 17 is applied to a container 12, the liner facing 190 becomes fastened to top lip 58 of a container 12. In the case of metallic foil, such foil is typically treated with a plastic coating and when the closed container is subjected to induction heating, a bond is formed between the liner backing 192 and the container 12. In the case of glassine material, adhesive is typically applied to the top lip 58 so that when the liner facing 190 is brought into engagement, a similar sealing bond is formed to seal the content of the container 12.

The seal assembly 184 is fastened both to the liner member 186 and to the container 12 and forms the means for holding the liner 186 stationary relative to the container 12 independently of the cap 132 during the initial opening movement of the closure 130 to bring the windows 170 into alignment with the sectors having the indicia indicating that the container has been opened. After the closure 130 reaches the opened position, continued movement in an opening direction causes the liner facing 190 and the liner backing 192 to separate since the bond formed by the wax between those two layers is substantially weaker than the adhesive bond between the liner facing 190 and the container 12 and the liner backing 192 and the liner member 186. The liner facing 190 remains sealed on container 12 and must be broken or removed to gain access to the container contents. This arrangement permits the use of closure 130 with a foil type or glassine inner seal.

Referring now to FIG. 18, another means is disclosed for inducing friction for the purpose of maintaining the liner member stationary while the cap is rotated relative thereto. In this instance, a closure 200 has a cup shaped cap 132 identical with that used in the embodiment illustrated in FIG. 11. However, the liner member is modified to form a liner member 202. This modification of the invention is particularly adapted for use with existing and conventional liners or seals indicated generally at 203. By way of example, many pharmaceutical companies already have their particular seals approved by the FDA and the closure 200 makes it possible to use such existing, approved seals.

The liner member 202 of the closure 200 has a general cup shape with an outer annular skirt 204, the inner wall of which is provided with a plurality of uniformly spaced radially inwardly protruding protrusions or knobs 206. The knobs 206 coact with one or more ratchet teeth 208 formed on the container 209. As disclosed in the drawings, the ratchet teeth 208 are substantially diametrically disposed but preferably are displaced approximately one-half of the spacing between adjacent knobs 206 to insure that the pair of ratchet teeth 208 cannot simultaneously be engaged with the outer face of a pair of knobs 206. At best, only one ratchet tooth 208 will be engaged with a knob 206 and the remaining ratchet tooth 208 will be disposed between a pair of adjacent knobs 206.

In operation and during the initial closing movement when the closure 200 is applied to a container 12, the knobs 206 are cammed over the outer ends of the ratchet teeth 208 to permit relatively free rotation of the closure 200 relative to the container 12. On the other hand, when rotation is attempted in the opposite direction, namely in the counter-clockwise direction, as viewed in FIG. 19, the ratchet teeth 208 engage at least one of the knobs 206 to prevent rotation of the liner member 202 relative to the container 12. However, after the cap 132 has been moved to an opening position in which the window 170 is aligned with a sector having the word "opened", any further rotation of the cup shaped cap 132 in an opening direction forces the ratchet teeth 208 past the knobs 206 to permit removal of the closure 200 as a unit from the container 12.

In this particular version, any form of seal element 203 can be used to initially seal the container. The seal assembly 203 need not be fastened to the liner member 202 since once it is placed in position, the knobs 206 will retain it until the closure 200 is applied to a container 12 and the seal assembly 203 is bonded thereto by such means as induction heating or adhesive.

The various embodiments thus far disclosed all have top reading messages, that is, the indicia such as "opened" or "sealed" is visible at the top of the outer cap. In FIG. 20, a modification is illustrated in which a closure 220 includes an outer cup shaped cap 222 and an inner liner 224 generally similar to the liner member 202 seen in FIG. 18. The principal variations in the cap 220 are that openings or windows 226 are formed in the side of the cap 222 which are alignable with indicia indicated at 228 and formed on the outside of an annular skirt 230 forming part of the liner member 224. In all other respects, the cap 220 can be similar in construction and operation to the closure 200 seen in FIG. 18. It will be understood, of course, that the embodiments seen in FIGS. 1, 11 and 17 also can be provided with side reading indicia as opposed to top reading indicia.

Several embodiments of a tamper indicating closure have been provided in which tampering, that is, placing the closure in a condition by which it can be opened, is made evident either by way of a message or by the appearance of the closure. In some embodiments of the invention, a printed message appears at the surface of the closure indicating that the closure has been sealed so that subsequently when a cap is rotated in an opening direction, the message is changed to one indicating that the closure has been opened or put in a condition by which it can be opened. Thereafter, the closure can be replaced and removed from the container when desired but the message or closure configuration always will indicate that the cap has once been opened. The change in messages is accomplished by a relatively movable cap and liner member in which the liner member is maintained in a fixed position relative to the container through means of an interferring frictional fit on the liner member and the rotatable cap. During the relative rotation, the messages or condition of the cap are changed and the cap is moved a small distance axially out of frictional engagement with the liner member to minimize frictional forces that might tend to move the liner until the cap comes into its final position showing that the closure has been opened. In all of the embodiments of the invention, tampering is indicated by a liner member which remains stationary during relative rotation of an outer cap from its original closing position to an opening position. Once the cap has been moved to the opening position, it remains in that position for all subsequent closing and opening movements of the closure and container.

The embodiments of the invention in which an exclusive property or privilege is claimed are defined as follows;

1. A tamper indicating closure for containers having threaded necks forming an opening, comprising: a cup shaped cap member having internal threads to engage with threads on said neck of said container, a liner member supported by said cap member for rotation relative thereto, said liner member having an annular flange with a radially outwardly facing cylindrical friction surface for engagement with a complementary surface on the inner wall of said opening in said neck, said liner member forming adjoining first and second sectors, a window in said cap member alignable with said first sector indicating an initially closed condition or with said second sector indicating that said closure has been opened, cooperating drive means including a drive lug on one of said members engageable with driven surfaces on the other of said members, said driven surfaces including a first surface engaged by said lug when said window is in alignment with said first sector upon initial rotational movement of said cap and liner member as a unit in a closing direction in which said liner member is movable axially in a seated position relative to the neck of said container, a second surface engageable by said lug following movement of said cap member in an opening direction relative to said liner member during which said friction surface remains seated and said window moves into alignment with said second sector after which said cap and liner members are moveable as a unit to remove said friction surface from its said seated position, a third surface between said first and second surfaces, said second and third surfaces being engageable by said lug when said window is aligned with said second sector for rotation of said cap and liner member as a unit for all subsequent movements of said closure in a closing or opening direction, a cam surface associated with said third surface to deflect said lug axially to pass to a position between said second and third surfaces while said friction surface remains seated, the resistance to axial displacement of said lug being less than the resistance to rotation and axial movement of said friction surface from the seated position.

2. The tamper indicating closure of claim 1 wherein said cylindrical friction surface has an outside diameter greater than the inside diameter of said opening in said container neck to provide interference between said friction surface and said container.

3. The tamper indicating closure of claim 1 wherein an arcuate recess is formed in one of said members and forms said first and second driven surfaces at opposite ends of said recess.

4. The tamper indicating closure of claim 3 wherein said cam surface is formed in the bottom of said recess.

5. The tamper indicating closure of claim 4 wherein said cam surface has an axial height less than the axial length of said cylindrical seal.

6. The tamper indicating closure of claim 1 and further comprising annular complementary load transmitting seats formed on said cap and said liner members to move said friction surface axially into a seated position upon closing movement of said cap member.

7. The tamper indicating closure of claim 6 wherein said third driven surface is positioned closer to said second driven surface than said first driven surface to permit rotational movement of said cap member relative to said liner member between said first and third surfaces to disengage said complementary load transmitting seats from each other to maintain low resistance to movement of said cap relative to said seal member in an opening direction.

8. The tamper indicating closure of claim 1 wherein said adjoining first and second sectors form a first set of sectors, a second set of sectors formed by additional first and second sectors, said cap and liner members being assembled so that said window is alignable with one of said sets of sectors.

9. The tamper indicating closure of claim 1 wherein said first and second sectors occupy no more than an arc of 180°.

10. The tamper indicating closure of claim 1 wherein said drive lug has an arcuate dimension substantially less than the arcuate spacing of said second and third driven surfaces.

11. The tamper indicating closure of claim 1 wherein said cylindrical sealing surface remains seated through an axial range greater than the axial deflection of said lug by said cam surface.

12. The tamper indicating closure of claim 1 wherein said annular flange is provided with a plurality of uniformly spaced axially extending ribs for engagement with a complementary surface on the inner wall of said opening in said neck.

13. The tamper indicating closure of claim 1 wherein said liner member is deflectable to press said friction surface into engagement with said complementary surface on the inner wall of the opening in said neck.

14. The tamper indicating closure of claim 13 wherein said friction surface is formed by a plurality of segments hingedly supported relative to the remainder of said liner member for deflection upon axial movement of said cap member in a closing direction on said container.

15. The tamper indicating closure of claim 1 wherein said window in said cap member is closed by a cover member joined to the remainder of said cap member by frangible portions, said cover member being formed with cam portions cooperable with complementary cam portions on said liner upon movement of said cap in an opening direction to fracture said frangible portions.

16. The tamper indicating closure of claim 15 wherein said cover member is completely separable from said window.

17. The tamper indicating closure of claim 15 wherein said cover member is hinged relative to said window and wherein fracturing of said frangible elements moves said cover member to a displaced position. relative to said cap member to signify opening movement.

18. A tamper indicating closure for a container having a threaded neck forming an opening comprising: a cup shaped cap having internal threads to engage with threads on said neck, a liner member supported by said cap for relative rotation, said liner member having an annular flange with a radially outwardly facing friction surface for engagement with a complementary surface on the inner surface of said opening in said neck, said friction surface on said liner member having an outer diameter greater than the internal diameter of the opening in said neck for exerting a radial force permitting axial movement of said liner member relative to said neck through another limited axial range while maintaining said frictional engagement, said liner member forming adjoining first and second sectors each with separate indicia, a window in said cap alignable with said first sector indicating an initially closed condition or with said second sector indicating that said closure has been opened, an arcuate recess in the top of said liner member, a lug formed on said cap and being disposed in said recess and being engageable with one end of said recess when said window is aligned with said first sector to rotate said cap and seal as a unit in closing direction and being engageable with the other end of said recess when said window is aligned with said second sector for rotation of said cap and seal as a unit in an opening direction, a ramp element disposed in said recess and being engageable with said lug to deflect said cap axially and permit rotational movement of said cap relative to said liner member from said closing position to said opening position, said ramp element forming a stop engageable with said lug to prevent relative movement of said cap and seal and maintain said window in alignment with said second sector during all subsequent closing movement of said closure, said ramp having an axial height greater than said limited axial range and less than the depth of said recess, said radial sealing force offering a greater resistance to rotational movement of said liner member relative to said container than said lug exerts on said ramp element during movement of said cap from said closing to said opening position.

19. A tamper indicating closure for containers having threaded necks forming an opening, comprising: a cup shaped cap member having internal threads to engage with threads on said neck of said container, a liner member disposed within and fastened at the axis of said cap for rotation relative thereto, said cap and liner members having portions engageable with each other for movement of said cap and liner members as a unit in both an initial closing position and in an opening position and being moveable relative to each other following initial closing movement to said opening position, said liner member forming adjacent first and second sectors, a window in said cap member alignable with said first sector indicating an initially closed condition when said cap member is in said initially closing position, one-way drive means on said cap and liner members permitting movement of said cap in an initial range from said initial closing position to said opening position and limiting return movement in a second range beyond a second closing position in which said window is aligned with said second sector indicating that said closure has been moved to an opening position, and means spaced from said threads and acting between said liner member and container for holding said liner relative thereto independently of said cap member during rotational movement of said cap member relative to said liner member, said liner member being removable from said container as a unit with said cap member after said window is aligned with said second sector and said members are in said opening position.

20. The tamper indicating closure of claim 19 wherein one of said friction surfaces includes a plurality of spaced friction inducing portions.

21. The tamper indicating closure of claim 20 wherein said friction inducing portions have a configuration permitting relatively free rotation of said liner member relative to a container in one direction and resisting rotation in the opposite direction.

22. The tamper indicating closure of claim 20 wherein said one friction surface is formed on said cap member.

23. The tamper indicating closure of claim 19 wherein said window in said cap member is formed in the side walls of said cup shaped cap member and is alignable with a selected one of said first and second sectors formed on said liner member.

24. The tamper indicating closure of claim 19 wherein said window in said cap member is closed by a transparent light portion to prevent access to said liner member.

25. The tamper indicating closure of claim 19 wherein a second window is formed in said cap member, third and fourth sectors formed in said liner member, said second window being alignable with said third and fourth sectors when said first named window is aligned with said first and second sectors, respectively.

26. The tamper indicating closure of claim 19 wherein said cap member and liner member are joined together by fastening means formed integrally with one of said members and passing through an opening in the other of said members.

27. The tamper indicating closure of claim 26 wherein said fastening means is formed by a post integral with said cap and is rotatably supported within an opening in said liner member.

28. The tamper indicating closure of claim 27 wherein said fastening means is attached to said cap portion by a weakened portion permitting breaking away of said cap and liner members in response to axial forcing of said cap member relative to said liner member.

29. The tamper indicating closure of claim 19 wherein said one-way drive means include cooperating elements on said cap and liner member, one of said elements being flexible to permit deflection relative to the other of said elements upon movement of said closure member from said initial closing position to said opening position.

30. The tamper indicating closure of claim 29 wherein said flexible element of said one-way drive means is integral with said cap.

31. The tamper indicating closure of claim 29 wherein said flexible element of said one-way drive means is integral with said liner.

32. The tamper indicating closure of claim 29 wherein said cooperating elements of said one-way drive means are both flexible.

33. The tamper indicating closure of claim 29 wherein said portions on said cap and liner members engageable with each other are formed on the sides of said cap member and liner member and wherein said one-way drive means are formed on the underside of said cap member and the top of said liner member.

34. The tamper indicating closure of claim 19 wherein said means for holding said liner member relative to said housing includes a seal assembly, means bonding said seal assembly to said container and to said liner.

35. The tamper indicating closure of claim 34 wherein said seal assembly including a first layer having a coating bondable to a container, a second layer having a coating bondable to said liner, said first and second layers being attached to each other for separation upon relative movement of said layers upon movement of said cap member relative to said liner member beyond said opening position.

36. The tamper indicating closure of claim 19 wherein said liner is generally cup shaped and wherein said means for holding said liner member relative to a container includes a plurality of uniformally spaced lugs formed on an interior wall of said cup shaped liner and engagable with the exterior of a neck of a container.

37. The tamper indicating closure of claim 36 and further comprising a tab element formed on the exterior of said container for coaction with said lugs to resist rotation of said liner upon movement of said cap member to said opening position.

38. The tamper indicating closure of claim 37 and further including a second tab element substantially diametrically disposed from said first named tab element.

39. The tamper indicating closure of claim 36 and further comprising a seal element disposed in said cup shaped liner member and retained therein by said lugs.

* * * * *